US010207168B2

(12) United States Patent
Bennett et al.

(10) Patent No.: US 10,207,168 B2
(45) Date of Patent: Feb. 19, 2019

(54) SURF POOL DESIGN AND CONTIGUOUS REEF

(71) Applicants: Walter Judson Bennett, Mechanicsville, VA (US); Matthew Gunn, Queens Creek, AZ (US)

(72) Inventors: Walter Judson Bennett, Mechanicsville, VA (US); Matthew Gunn, Queens Creek, AZ (US)

( * ) Notice: Subject to any disclaimer, the term of this patent is extended or adjusted under 35 U.S.C. 154(b) by 0 days.

(21) Appl. No.: 15/363,515

(22) Filed: Nov. 29, 2016

(65) Prior Publication Data

US 2018/0147469 A1 May 31, 2018

(51) Int. Cl.

| | |
|---|---|
| ***E04H 4/00*** | (2006.01) |
| ***A63B 69/00*** | (2006.01) |
| ***A63G 31/00*** | (2006.01) |

(52) U.S. Cl.

CPC ..... *A63B 69/0093* (2013.01); *A63G 31/007* (2013.01); *E04H 4/0006* (2013.01)

(58) Field of Classification Search

CPC .... A63B 69/0093; A63G 31/007; E04H 4/14; E04G 4/0006

USPC ..... 4/513, 491; 405/79

See application file for complete search history.

(56) References Cited

U.S. PATENT DOCUMENTS

| | | | | |
|---|---|---|---|---|
| 8,496,403 | B2 | 7/2013 | Lochtefeld | |
| 8,561,221 | B2 | 10/2013 | Lochtefeld | |
| 2003/0119592 | A1 | 6/2003 | Lochtefeld | |
| 2008/0060123 | A1* | 3/2008 | Johnson | A63B 69/0093 4/491 |
| 2009/0151064 | A1* | 6/2009 | Mladick | A63B 69/0093 4/491 |
| 2010/0000014 | A1 | 1/2010 | Lochtefeld | |
| 2010/0017951 | A1* | 1/2010 | Odriozola Sagastume | A63B 69/0066 4/491 |
| 2010/0088814 | A1* | 4/2010 | Johnson | A63B 69/0093 4/491 |
| 2012/0020735 | A1* | 1/2012 | Fricano | E04H 4/0006 405/79 |
| 2014/0304905 | A1* | 10/2014 | Bennett | E04H 4/0006 4/491 |
| 2015/0089731 | A1* | 4/2015 | Lochtefeld | E04H 4/0006 4/491 |

OTHER PUBLICATIONS

"Contiguous" Merriam-Webster.com. Merriam-Webster, Mar. 5, 2018.*

(Continued)

*Primary Examiner* — Benjamin R Shaw

(57) ABSTRACT

A surf pool design comprising of an artificial contiguous reef, consisting of a first and second reef sub sections and a specific surf pool design that function together to create a surf pool for recreational surfing. Aspects of the invention provide a surf pool including a contiguous artificial reef of any shape or size. The continuous artificial shaped reef can include an inclined slope traversing the reef from the tip of the first artificial reef sub section to the open end of the second artificial reef sub section. The definition for the purpose of this invention an artificial contiguous reef, is a reef that is angled, contoured and shaped to the bottom of the surf pool. The meaning of pool in the embodiment is any artificially created body of water such as a pool, lake or lagoon which is constructed for the purpose of recreational surfing.

1 Claim, 1 Drawing Sheet

(56) References Cited

OTHER PUBLICATIONS

Double V Reef: Publication No. US20090151064 A1 Publication type Application U.S. Appl. No. 12/337,354 Publication date Jun. 18, 2009 filed Dec. 17, 2008 Priority date Dec. 17, 2007 Also published as WO2009079605A1 Inventors : Richard Carnahan, Richard Mladick.

Wave Pool and Reef Design: Publication No. US20080060123 A1 Publication type Application U.S. Appl. No. 11/890,953 Publication date Mar. 13, 2008 filed Aug. 8, 2007 Priority date Aug. 8, 2006 Also published as WO2008039271A2, WO2008039271A3 Inventor: Garrett Johnson.

Wave Pool Construction: Publication No. EP1242703 B1 Publication type Grant Application No. EP2000987853 Publication date Jun. 28, 2006 Filing date Dec. 13, 2000 Priority date Dec. 13, 1999 Also published as EP1242703A1, EP1242703A4, U.S. Pat. No. 6,912,738, US20030106146, WO2001042592A1, Inventor: Kerry Peter Black.

* cited by examiner

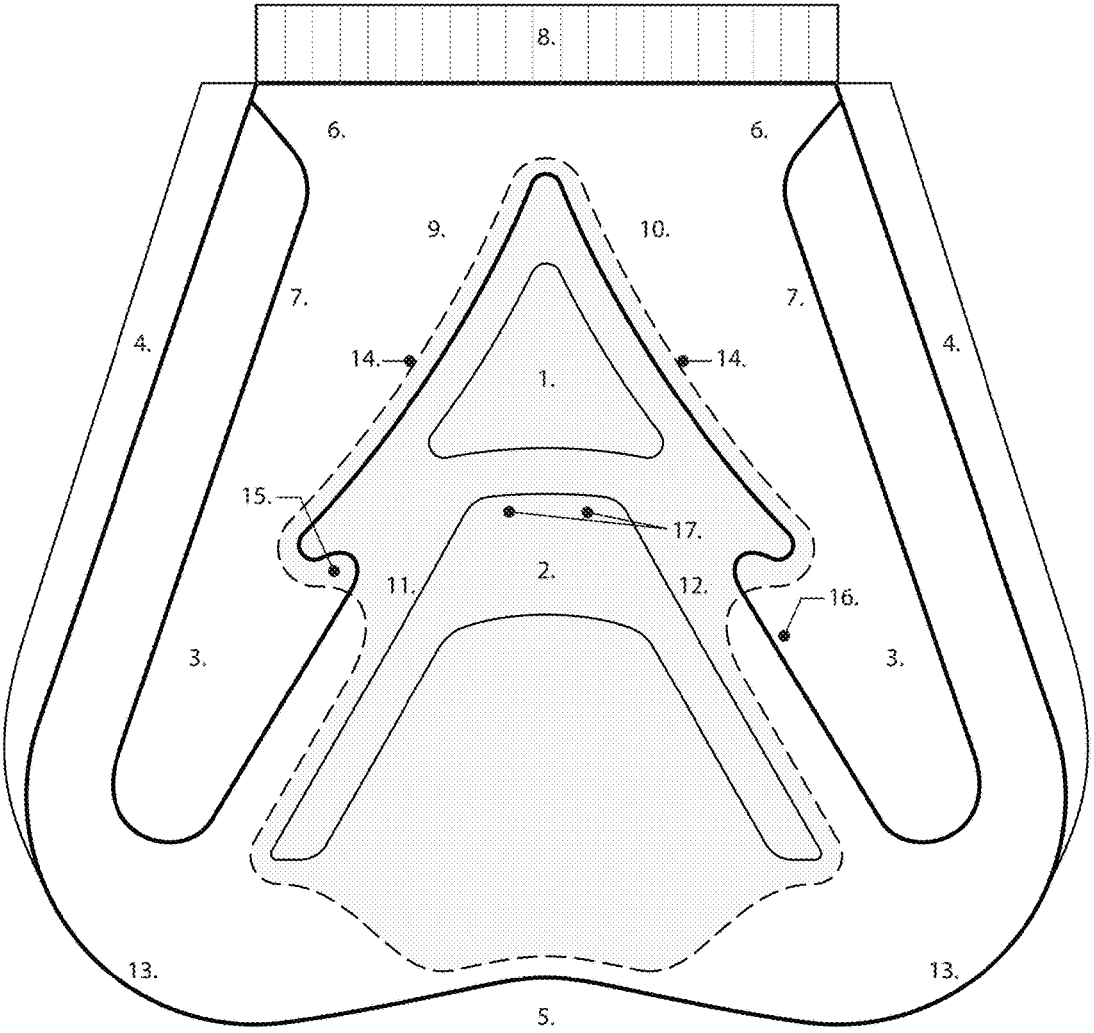
8.
6.
6.
9.
10.
7.
7.
4.
4.
14.
14.
1.
15.
17.
2.
11.
12.
16.
3.
3.
13.
13.
5.

SURF POOL DESIGN AND CONTIGUOUS REEF

BACKGROUND OF THE INVENTION

Surf pools often use conventional wave generators to produce waves. These conventional surf pool wave generators are most commonly pneumatic, vacuum; drop water system powered or are plows towed through the water to create a wave. The design of a surf pool is a very important factor in the production of waves. It is difficult to configure a wave pool to provide desirable waves, i.e., waves that are suitable for use in water sports such as surfing, body surfing, and kayaking. Even at the best natural beaches, perfect waves are rare. This is because the quality of the waves depends upon many factors, such as environmental conditions, such as tides, wind, and off shore storms.

Conventional surfing pools have typically been sized and configured so that when used for surfing, only a single surfer could safely ride a wave. Some wave pools have the capability to produce waves that break from the right hand side of the wave or the left hand side of the wave. Center breaking waves, which are more complicated and difficult to produce, are sometimes referred to as "Point" or "A-Frame" waves.

Surf pool construction and operation can also be costly. Surf parks can require a minimum of 10-12 acres, extensive infrastructure, staffing, and considerable energy consumption for the generation of waves. Surf Pools have been historical very costly to build. (10-25 million). With the high cost of concrete, rebar and labor cost, has led to a very slow expansion of surf parks across the world. The current Inventor has invented a new surf pool design and shape which has greatly reduced the size of footprint, cost and build out time, to build a surf pool. Surf pools that are capable of producing large, surfing waves can be even more expensive. The expense of generating surfing waves may be calculated on a cost per wave basis. Some facilities charge surfers based on their expected revenue per wave. In this current invention is a surfing pool design capable of increasing the number of surfers who may safely ride a generated wave, thereby improving the revenue per wave.

Surfing pools for generating waves suitable for surfing have been previously proposed and in some instances are used commercially in surfing pools or surfing parks. Previous surfing pools known to the present inventor have not been capable of generating waves suitable for surfing or tube riding over an artificial contiguous reef of varying surfable sections. Tube riding is riding a boogie board, surf board inside a breaking wave. The surfer typically rides the shoulder or the base of the wave at the leading edge of the break as it progresses laterally along the wave front, and the surfer can also ride inside the breaking part of the wave. In contrast to plunging or barreling waves are spilling waves, which break without forming tubes or barrels. For the purpose of our invention we will be focusing on plunging breaking waves that are formed by one contiguous artificial reef, with different reef sections as part of the contiguous reef.

Current reef inventions have been detachable, inflatable add ins to the pool. The current invention is one contiguous artificial reef structure that is intentional designed and shaped with different slopes, angles and contours and reef sections, to maximize wave height shape and form.

Waves that are generated artificially for surfing or recreation in a body of water known as a Surf-Pool must meet a number of criteria:

1. They must be of sufficient size and preferably exceed one meter in height. (3.28 feet).
2. They must travel at their natural velocity from the wave-making apparatus towards a sloping or contoured beach where they may break and dissipate their energy without being reflected.
3. For the installation to be economically viable, they must be produced at a high repetition rate, preferably in excess of 180 surfable rides per hour.
4. The waves should be essentially monochromatic, i.e. of a single frequency and without any significant smaller intermediate waves or harmonics or parasitic waves.
5. Waves should begin with a trough followed by a wave crest.
6. Waves should have 'laminar flow' characteristics as opposed to 'turbulent flow'.

By controlling the bottom profile of the Surf-Pool, or the direction of the waves, or a combination of both, the waves should be caused to break or peel progressively from one end to the other, thereby creating waves that are of interest to surfers.

The peel angle is a critical term used to describe the speed that a surfer needs to travel to successfully traverse across the face of a wave. Good surfing waves break in a 'peeling' manner, where the breaking region of the wave translates laterally across the wave crest It is the area close to the breaking crest of the peeling wave, known as the 'pocket', which has the steepest face and therefore offers the most speed for surfing. The peel angle is defined as the angle between the trail of the broken white water and the crest of the unbroken part of the wave as it propagates shoreward. Peel angles range between 0° and 90°, with small peel angles resulting in fast surfing waves and large angles in slow surfing waves. There is a limit to how small the peel angle can get before it becomes impossible for a surfer to stay on the unbroken wave face, ahead of the breaking section; when this is no longer possible the wave is termed a 'close-out'. On the other hand, as the peel angle increases towards the maximum of 90°, peel speed is reduced until it becomes too slow to be considered good for surfing. The extremes of peel angle are easy to envisage, but what peel angles are the best for surfing, and in particular, what peel angles should a wave break at for particular sized waves, different types of surfing and along specific sections of a break.

Peel angle has a huge effect on the rating of the skill level of surfers. Ratings are independent of surf break quality or the degree of difficulty of waves. As the peel angle is lowered away from 90 degrees the surfing level becomes more difficult. The ideal peel angle in the current invention is 45 degrees.

Peel angles are also influenced or enhanced according to swell direction, the angle at which a swell or unbroken wave approaches the reef angle. Storms at the incorrect angle may even "pass by" and not refract into the reef. Wave quality is enhanced when each reef angle is correctly matched with the ideal swell angle. Natural surfing locations in the ocean will harness swell energy generated by offshore storms when those storms are at the correct distance and angle. The correct swell angle enhances the swell size and direction as the swell approaches the reef angles at the ideal intersection.

It is the underlying bathymetry that influences the shape of breaking waves the most. The transition of breaker shape, from spilling through to surging, is mainly a result of increasing seabed gradient. On low gradient seabed's, waves break with a spilling form. As seabed gradients increase, breaker form tends towards plunging, and finally to collapsing or surging waves on very steep gradients. Of the four breaker types used to classify wave breaking intensity (spilling, plunging, collapsing and surging), spilling and especially plunging waves are required for surfing. Collapsing and surging breakers occur at the water's edge or where very steep seabed gradients come close to the water's surface. Such waves cannot be surfed because they lack a steep smooth face and/or they break at the water's edge, i.e. a surf zone through which breaking waves propagate does not exist. Indeed, surfing requires a steep unbroken wave face to create board speed for performing maneuvers.

While both spilling and plunging waves are utilized for surfing, the face of a spilling wave is relatively gently sloping and therefore provides low surf board speed in comparison to the steeper-faced plunging wave. The transition from long-boards prior to the 1970's to the short-boards used by most surfers today has meant that steeper and steeper waves are sought for surfing, since the lower volume short-boards require steeper more intense waves to ride. As a consequence, spilling waves are not preferred for surfing, except by beginners in the early stages of learning; it is plunging waves that are sought by today's surfers. The steep face of a plunging wave provides the speed needed to perform maneuvers, not unlike a steep mountain face required for skiing. In addition, the open vortex of the plunging wave provides the opportunity to perform surfing's ultimate maneuver, the tube ride, where the surfer rides under the breaking jet of the wave. Even though the seabed gradient has the greatest effect on wave breaking characteristics, wave height and period also affect the breaking intensity of waves.

There are many degrees of intensity at which plunging/surfing waves can break. As is implied by the sequence of breaker types (spilling though to surging), there is a transition between them and so it follows that within a category there is also a sequence, e.g. from gentle plunging to extreme plunging. This range of breaking intensity of surfing waves is reflected by the different terms used by surfers to describe surfing waves. As mentioned above, spilling waves are usually not preferred for surfing due to the difficulty in generating board speed on the gently sloping wave face. Surfers often term spilling waves as 'fat' or 'gutless', which indicates the lack of speed/power that can be generated on them while surfing. There are many descriptive terms that surfers use to describe plunging waves such as 'tubing', 'hollow', 'pitching' and 'square'. However, exactly what is meant by a specific term, and how this relates to the wave's breaking intensity, is subjective and often depends on the experience of a surfer. A definitive description of wave breaking intensity is required to relate the subtleties of surfing waves in a way that can be universally understood. Thus, it is critical to have a highly-refined definition of the wave breaking intensity and to define the actual shape of the plunging wave profiles.

A large amount of work has been done on the profile shape of a breaking wave, mostly in wave flumes using linear seabed slopes. In order to describe wave breaking characteristics a non-dimensional parameter is employed, such as the Irribarren number, the surf scaling parameter or the surf similarity parameter. These methods take into account all forms of wave breaking (spilling through to collapsing). All are based on wave steepness ($Hb/L\infty$) and a single value of beach slope, $\beta$. Where $\beta$ is the beach slope. Once $\xi b$ is calculated, it is used to classify the breaker type, with higher values indicating higher intensity breaking and each breaker type classified within a range of values. For instance, $0.5<\xi b<3.3$ indicates plunging waves. However, while these methods give an indication of breaker intensity, studies of surfing wave shape have found that they do not well differentiate the transition between breaker categories. In addition, these values do not describe the actual shape of plunging/surfing wave profiles, or tube shape, which is imperative for describing surf quality when communicating reef design to the relevant parties The 'vortex ratio' (i.e. tube length to width) is a measure of the 'roundness' of the tube and can therefore distinguish between subtle differences in the tube shape. As the ratio of vortex length to width approaches, the tube shape becomes more circular and less elongate and breaking is more intense. Breaking wave intensity is described in five categories from extreme to medium. Waves of greater than extreme are likely to collapse (although an exact limit to vortex ratio is yet to be established) and are therefore unsurfable, and waves of less than medium fall into the categories of gentle plunging and spilling, which, while still surfable, are generally not considered high-quality by surfers. The shape of each category is described in surfing terminology and examples of surfing breaks with similar breaking intensity and a picture of a wave breaking in profile at an example surfing break is also provided to give a full picture of the type of plunging wave that particular reef designs will produce.

The reef gradient responsible for the intensity of the breaking wave is the 'orthogonal' seabed gradient, that is the gradient the wave is travelling along, not the actual gradient of the reef (which is referred to as the 'contour normal' gradient). The orthogonal seabed gradient proved to be the most useful for predicting the breaking intensity because waves at surfing reefs do not approach normal to the seabed contours. On the contrary, waves must arrive at an angle to the seabed contours to provide a surfable peel angle, which is one of the most important factors required for high-quality surfing waves. This relationship between the reef gradient and breaking intensity is described by the linear equation, $Y=0.065X+0.821$, where X is the orthogonal seabed gradient and Y is the vortex ratio.

Even though the seabed gradient has the greatest effect on wave breaking characteristics, wave height and period also affect the breaking intensity of waves. Breaking intensity increases with increasing period and decreasing wave height. With respect to using equation above for predictions of plunging wave shape, it is important to know to what degree the changes in wave height and period effect the wave breaking intensity. This method of predicting the tube shape of breaking waves is simple and more than adequate for the purpose of predicting the tube-shape of surfing waves. However, it does not incorporate wave height or period and is restricted to the category of surfing, or plunging, waves. As discussed above, the plunging wave intensity is proportional to the beach steepness and inversely proportional to the square root of the wave height (Equation 1 above, the Irribarren number). This means that smaller waves will break with a stronger plunging nature than larger waves on a uniform slope. Scientifically, it has also been shown that waves break in water depths that are roughly proportional to the wave height (0.78 wave height to depth is the rule of thumb, but more generally ratios of about 0.5-1.0 wave height to water depth are observed). This means that smaller waves break in shallower water than larger waves.

With respect to wave breaking quality, as explained above, wave breaking intensity decreases with increasing wave height for a particular seabed gradient. This means that if a surfing reef gradient is linear, as the wave height increases the breaking intensity will decrease. Since high-quality surfing waves require steep wave faces to generate adequate board speeds needed for performing advanced surfing maneuvers, the lessening of breaking intensity with increasing wave height is a negative aspect of a linear reef gradient. However, since wave breaking intensity is related to the seabed gradient, a convex reef gradient compensates for the undesirable reduction in wave breaking intensity that occurs with linear gradients, i.e. as the depth increases so does the reef gradient which in turn ensures that breaking intensity does not significantly decrease. Thus, a convex reef face profile can be used to optimize surfing quality.

Reef Shape:

There are a variety of properties that put high-quality surfing breaks in a category of their own, but it is the seabed shape that has the largest influence on the form of a breaking wave and therefore the quality of a surfing break. The reef shape dictates the wave peel angles and the wave breaking intensity. However, while a peel angle of 45° is conducive to a surfing break for competent surfers in most cases a reef shape of 45° will result in peel angles considerably lower (i.e. faster) due to the process of refraction. Refraction changes the direction of wave propagation causing wave crests to align more parallel with the seabed contours. This is important for surfing because it alters the peel angle. The closer aligned the crest lines and the isobaths become, the greater velocity the surfer must attain to successfully ride the wave. Therefore, depending on the depth of the Reef, waves 'wrap' up onto the reef so that by the time waves begin to break the peel angle is significantly lower.

Analysis of surfing break bathymetries of reefs around the world, identified a series of commonly occurring components from which all surfing breaks are comprised. The geomorphic components were classified as ramp, platform, wedge, ledge, focus (point), ridge and pinnacle. These components account for the high wave quality at world-class ocean surfing reefs. Waves are refracted towards the favored orthogonal direction (intersecting or lying at right angles), as they travel up the ramp. Waves are refracted away from the favored orthogonal direction (intersecting or lying at right angles), as they travel up the wedge. Local Wave height convergence occurs as waves travel up a focus or (point). Very little refraction occurs as waves travel up a ledge. A steeper seabed gradient or slope and deflection is isobaths orientation results in a hollower and faster section in the wave as it travels up a ridge. An isolated region of shallow bathymetry causes the wave to rear up and steepen as it travels over a pinnacle.

In the Current Invention Our Surf Pool and Artificial Reef Design Criteria:

- surfability over the widest possible range of wave heights, periods and directions in order to maximize the number of surfable waves per hour;
- surfability across the full range of design wave heights;
- suitability for excellent surfers and average surfers aspiring to be excellent;
- at least one "section" hollow enough for tube riding;
- a steep wall for board speed, and;
- a fast and elongated take-off with sufficient steepness to allow adequate board speed for entry onto the main section of the ride.

PRIOR ART

Unlike in Odriozola Sagastume (US Patent Publication 2010/0017951), the patent the reef is submerged into the body of water. In contrast, in the current invention the contiguous reef and reef sub sections are shaped, angled and contoured directly into the bottom of the pool, lake or body of water. Also the reef in the current invention is sloped, angled and contoured in nature as it twists, shapes and contours in different forms and depths to create different bottom reef shapes. In Sagastume, the invention is an inflatable plow or modular plow (designed as a delta wing as described within the invention), that is pulled along a track via a cable or on a motorized track. In the invention the modular plow or movable inflatable reef is pulled toward and through the water to create the wave. In the current invention the wave or swell after being generated by the plunger wave generator comes to the artificial reef and transverses the reef to make the wave. Our reef is stationary and fixed and does not move. However in the current invention the reefs have calculated pre-determined depths, slopes and angles that create the function. In Sagastume, the invention fails to state the definition of "sloped, angled and contoured" or "artificial reef." There is no mention of an artificial reef. As that terminology and language is only specific to the current invention. In the current invention "sloped, angled and contoured" in relation to the artificial reef is clearly and specifically defined. Odriozola Sagastume also fails to show multiple reef section structures or multiple surfable areas within the pool.

Unlike in Garrett Johnson (US20080060123 A1), the patent includes multiple reefs being located in the pool, see. FIG. 5. The reefs are strategically placed in the pool to maximize the number of surfers the pool can have at one time. However, in contrast, in the current invention there is one "contiguous" reef, with different reef sections, located within the one contiguous artificial reef and not multiple reefs. The current invention has one big contiguous reef, with different sloped, angled and contoured reef sections with different contour depths and shapes within each reef section. In Johnson, the reefs are detached, separated and specifically different non-attached reef structures compared to the current invention. Johnson, claims the multiple reefs placed through the water body as long as they are geometrically in line of the wave. The current inventions reefs can be placed in a number of various positions and directions versus directly pointed only in line with the wave generator as the wave generator in the current invention provides for multiple swell angles which will direct wave energy into reef focal areas anywhere between 90 degrees and negative 15 degrees according to the wave generator location. Furthermore the current inventions edge shallows (side reefs) are directed away from the wave generator and general geometry water course in order to dampen wave energy at the end of the water body. The swell energy is directed into these negative degree areas through swell directional changes from the wave generator.

Unlike in Carnahan (US20090151064 A1), Double V Reef, the gist of the patent are contoured reef structures to the bottom of a wave pool, however the reefs are "separate" distinct reefs separated by an "arrow" shaped deep part. In the current innovation the reef is one contiguous reef structure, which includes different reef sections within the same contiguous reef. Also in Carnahan the Double V Reef is a general contoured bottom with different gradient slopes. (ie. 1-6 slope, 1-10 slope, 1-15 slope etc.). The contours are limited to going from a steep gradient slope up to a shallow gradient slope and vice versa. In the current invention the reefs are sloped, angled and contoured. The artificial reefs have the ability to increase or decrease slope gradients but also have the ability to include angles from 0 degrees to 90 degrees and different contoured shapes within the reef. We have one contiguous reef with multiple sections. While the current invention has a reform area in between the sections the current inventions inside wave section of the contiguous artificial reef is comprised of a wide "U" shaped break section for the specific purpose of creating additional surf points in the section. Allowing greater volume of riders to sit in the take off point with safe distance between them.

In the present invention the contiguous reef is placed in an open body of water without walls. In the present reef invention the reef face pitch is comprised of multiple gradients and depths which adjust within the reef wall as it travels from beginning to end. As the reef travels shallower the gradient pitch of the reef adjusts in both top to bottom gradient between 1:5 to 1:15 and in depth in order to produce a plunging wave the full length of the reef. This gradient vertically adjusts the plunging motion of the wave to give the most desirable barrel on an almond shape. Rather than turning the end of the reef outward to extend the ride length our reef at certain sections bends and turns inward (as shown in FIG. 1), providing extended ride sections in a more confined space. This is necessary to limit the length of the wave generator and wave generator cost.

Unlike in Cobylyn, (WO/2009/132378), the patent is a detachable reef, that is made of PVC piping, bamboo, aluminum or metal and is anchored to the floor of a wave pool. The detachable reef also can be adjustable, where the angle of the reef can be adjusted more forward or more backward. In the current invention the contiguous reef is fixed and is contoured, sloped and angled within the bottom of the surf pool.

Unlike in Lochtefeld (20150107013), and (U.S. Pat. No. 8,561,221), The inventions comprise a method and apparatus for reducing detrimental wave reflections and rip currents and Method and apparatus for damping waves within a wave pool by providing a wave damping chamber preferably downstream from the breaker line that absorbs wave energy and dampens waves, wherein larger surfable quality waves can be produced within the wave pool at greater frequencies without increasing pool size or floor design hazard. The current invention is not claiming to reduce wave reflections and rip currents, however our artificial contiguous reef does effect surface waves in a surf pool.

Unlike in Lochtefeld (20150089731), the invention is a wave pool having multiple wave breaking zones extending across the pool floor, wherein different wave breaking formations with different wave characteristics can be generated within each zone, using the same wave energy derived from the same original wave, wherein surfers with different abilities can surf in different locations within the same pool. Specific features are provided that enable breaker waves to be properly managed and controlled such that intermediate/advanced surfers can surf in one zone and beginner surfers can surf in another zone. Included are special dividers to prevent surfers from crossing from one zone to the next, while at the same time, allowing wave energy to pass through. An attenuating means is provided to help reduce the choppiness of the waves. Unique exit areas are provided along the sidewalls to enable surfers to exit from the wave pool at various locations, such as directly from the zones, so that surfers don't have to surf or traverse all the way to the shallow end to exit the pool. The invention comprising a plurality of wave-breaking zones extending across the pool floor, wherein each zone has a substantially inclined pool floor section followed by a substantially declined and/or level pool floor section, and each is in the shape of a V from above. The current invention is unlike the invention in Lochtefeld, because the current invention is one contiguous artificial reef structure and is not separated by declined or level pool sections. The current invention also does not contain separate distinct reefs, multiple separated or adjacent reef sections separated by a deep water area. Also in Lochtefeld the reefs are all the same shape and contour and size. In the current invention the artificial reefs are all differently contoured, angled in a fashion from 0 degrees to 90 degrees, and shaped and sized to create different wave shapes and heights.

Unlike in Lochtefeld, (US 20030119592 A1) and (US20100000014 A1) and (U.S. Pat. No. 8,496,403 B2), The inventions relates to a wave generating system comprising a wave generator (moving reef module), that travels along the surface of a body of water, and preferably in the middle thereof, wherein the wave generator can create both primary and secondary waves that travel toward the shore. The primary waves are intended to allow surfing maneuvers to be performed in a relatively deep water environment. In the preferred embodiment, the body of water has opposing undulating shorelines upon which the secondary waves can break, wherein by modifying the shoreline's slope and curvature, and providing undulating peninsulas and cove areas, various multiple wave formations and effects can be created. The inventions are a "moving reef generator," where the reef shaped module is pulled along a tracking system by means of a cable and motor or some type of linear motor system. Unlike in the current invention, the Lochtefeld invention does not contain contoured reefs or artificial reefs in the bottom of a wave or surf pool.

SUMMARY OF THE INVENTION

A surf pool design comprising of an artificial contiguous reef, with different reef sub sections and a surf pool design that function together to create a surf pool for recreation surfing. The surf pool design has effects on whether the wave diverges, converges, or is angled. Another objective of the present invention to provide a contiguous artificial reef, with different reef sections within the contiguous reef, to affect the surface waves in a pool, lake, pond and river, or body of water, which produces plunging and barrel type breaking waves that exhibit progressive breaking laterally along the wave front so the waves can be used for surfing. Another object of this invention is to provide a surfing pool which produces plunging type wave substantially at a constant wave peeling rate and frequency along the wave front to facilitate reading of the waves by the surfers as they break over the artificial reef. Other objects and advantages will become apparent from the following detailed description and the accompanied drawings.

In accordance with the present invention, the foregoing objectives are realized by forming a contiguous artificial reef having a wave breaking surface which inclines upwardly towards the shore of the surf pool at a pre-determined angle, and generating and forming waves on the wave generator side of the reef. Propagating toward the shore the waves having steepness sufficient to cause the waves to break in a plunging barreling way as the wave traverse the wave breaking surface of the artificial reef.

To produce waves that break in a plunging way, the slope of the inclined portion of the artificial reef surface is preferably $1/25$ and is most preferably at a range of $1/6$ or $1/10$, $1/15$. When the slope is less than $1/25$ the wave breaks without plunging. The acute angle or (peel angle) between the wave front and the wave breaking surface on the reef surface is preferably in the range of 30 degrees to 70 degrees. We have found that the optimal peel angle is between 45-55 degrees. At angles less than 30 degrees the wave tends to peel too fast, making it very difficult for the surfer to keep up with the peel speed of the wave. If the peel angle is greater than 70 degrees excessive energy can be lost on wave breaking, and the wave can become undesirable small. By selecting different peel angels it is possible to change the range of difficulty of the wave sin the surf pool. For a more difficult surfing pool the peel angels should be closer to 30 degrees and for ales difficult wave the peel angel should be set at closer to 70 degrees.

The contiguous artificial reef, with reef sub sections will be formed and shaped into the bottom of the surf pool such that the waves are able to propagate over the artificial contiguous reef. The positioning of the artificial reef in the surf pool will be determined many factors such as pool design, types of waves, wave heights, water depth, etc. Strategic placing of the reef sub sections in the surf pool will maximize the propagating of the waves of the reef surface. The artificial reef sections, will affect the height of the wave, shape of the wave and the rate at which they peel and break. The solid reef is able to cause a wave which propagates over the reef after it passes over the reef. The artificial reef sections will be shaped and made to contour the bottom of the surf pool, pond, lake, river or lagoon.

Advantages of the Current Surf Pool Design Invention:

Provide a single wave or series of waves in a surf pool.

Allow an adjustable wave profile.

Allow adjustable shape and direction of the wave fronts.

Minimize energy needed for wave generation.

Minimize cost of hardware for the wave generator and supporting structure.

Minimize the cost and complexity of maintenance of the wave generation equipment.

SUMMARY OF THE EMBODIMENTS

In one embodiment there is disclosed is a surf pool for creating multiple surf-able waves when a wave generating device forces water into a first end of the surf pool. The surf pool includes a first deep area adjacent the end of the surf pool having the wave generating device. It is followed by a premier artificial shaped reef section that creates a shallow area that causes a swell created by the wave generating device to become a surf-able wave. The center reef adjusts in depth and angle to form an additional inside surf-able reef section, which extends the surf ride. At the end of the surf pool and to the sides is a circle or ball shaped area of the pool, a basin and swash area for dissipating the remaining energy of the surf-able wave.

BRIEF DESCRIPTION OF THE DRAWINGS

FIG. 1 is a top view illustration of one embodiment of a surf pool according to the present invention.

In order that the invention may be more fully understood and put into practice, a preferred embodiment thereof now will be described with reference to the accompanied drawings.

DETAILED DESCRIPTION OF THE DRAWINGS

Before any aspect of the invention are explained in detail, it should be understood that the invention is not limited to its application in the details of construction and the arrangement of components set forth in the following description or shown in the following drawings. The invention is capable of other aspects and of being practiced or of being carried out in various ways. Also, it should be understood that the phraseology and terminology used herein is for the purpose of description and should and should not be regarded as limited.

Before any aspects of the invention are explained in detail, it is to be understood that the invention is not limited in its application to the details of construction and the arrangement of components set forth in the following description or shown in the following drawings. The invention is capable of other aspects and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

As used herein, the term surfing is defined to include bodysurfing, board surfing, sail boarding, wake boarding and any other recreational activity that requires waves. Thus, the present invention is useful for a variety of surf related activities, and the terms "surf" or "surfer" or "surfing" should be construed as meaning any surf related activity and its participants.

The bottom topography of a body of water is one of the factors in how a wave breaks. Most surfing pools include some form of incline and a simulated beach opposite the wave generator. Natural beaches have inclines that range from steep (reflective of waves) to gradual (dissipative of wave energy). Surfing pool artificial reefs foster the creation of surf and then provide a dissipative end or swash zone for the beach. That is, these pools often have a bottom incline that culminates in a gradually inclined beach area. Prior to the swash zone, the incline is typically steeper to support the conversion of swells into the peaked waves of surf. As swell progresses into increasingly shallow conditions, the swell grows vertically relative to the water level, creating surf. Friction with the bottom slows the deeper portion of the wave until the peaked wave begins to curl. As the wave passes over the continuing incline, eventually the surf curls and breaks, washing up the incline of the beach and dissipating energy.

Description of FIG. 1:

This FIGURE shows the Premier or first placed artificial reef sub section 1 that slopes and shapes, angles to create contours in the surf pool. The front of the artificial reef sub section is slightly elongated to slow the breaking of the wave down for surfers to have a more controlled take off point. The Premier reef sub section is part of the secondary Artificial Reef sub section as one contiguous reef. 14

This embodiment shows the "Secondary Reef sub section" 2 section to be placed in the surf pool. This embodiment shows the Secondary Reef sub section is shaped in an upside down U shape. The secondary Reef sub section 2 is connected to the premier reef sub section 1, as one contiguous reef. 14

This embodiment shows the "Side Reef" 3 section to be placed in the surf pool. This FIGURE shows the Side Reef is shaped in an angle to the swell, to allow the wave to break in shorter distances or beach break on the side contours of the surf pool. The Side Reef sections 3 are not connected to the premier reef sub section as part of the contiguous artificial reef. 14

The top view illustration of the embodiment of the Surf pool is shown in which waves travel after being generated by plunger wave generator 8. Opposite plunger wave generator 8 is beach area 5. Alternatively, surf pool may include a more gradual or dissipative increase in elevation so that the depth becomes increasingly shallow over the run of a wave, depending on the type of wave desired and the energy required.

The present invention may also be used with one or more wave diversion channels, lazy rivers, or action rivers for redirection of wave energy, as desired. Further, the present invention is also applicable for pools of a wide variety of geometric shapes, so long as the system of artificial reefs is configured in a manner to complement the geometry of water course in the surf pool.

For the embodiment shown in FIG. 1, one contiguous artificial reef system, 14 having artificial premier reef sub section 1 and inside surf-able extension reef sub section 2 are disposed within surf pool. In this embodiment, premier artificial reef sub section 1 comprises a triangle shaped primary reef sub section, which works in conjunction with deep side channels 7. The primary shallow or elevation of primary artificial reef sub section 1 may take a variety of shapes to produce a desired wave form and is not intended to be limited to just that shown in FIG. 1.

In order of progression a force of water emanating from the plunger wave generator 8 encounters the contiguous artificial reef 14 and the center primary artificial triangle reef sub section 1, side reefs 3, and then beach area 5. In channel areas, the water is in the form of a swell. In shallow areas, the water becomes a wave and builds to form a surf-able crest or peak while wave energy is expended by movement and friction. Of course, such embodiments may include a single contiguous artificial reef or more inside sections of the contiguous artificial reef, as may be desired for the application.

The side artificial reefs 3, create a plunging wave on the sides of surf pool up to the infinity edge 4. This wave may run for the full length of surf pool until reaching beach area 5. The surf pool walls 4 start at 45 degrees at the wave generator end of the pool and go down to 0 degrees at the beach end of the pool. 5

The embodiment of FIG. 1 may be used with up to four (4) surfers, depending on the size of surf pool and the desired configuration. The first take off point are on either side of the primary reef sub section at 9 and 10. The take-off points in succession are on the second reef sub section of the artificial reef at 11 and 12. The take-off points are to the left and right of the front of the primary and secondary reef sub section. There is two additional take off points on the side reefs sections 3 and at 6.

The embodiment of FIG. 1 shows a return paddle out channel 7 at the beach end of the surf pool, going to the side of the contiguous reef 14 and the side reefs 3. The return channel 7 functions as a paddle out channel for the surfers returning to the surf line up.

The embodiment of FIG. 1 shows rounded sides of the surf pool, circular shaped 13 at the beach end of the pool 5. The rounded sides 13 help damper currents and spread out the energy from the waves in the surf pool and also function as a kick out for surfers completing their surf ride. The embodiment of FIG. 1 also shows a cut back hook area 15 within the surf pool. The cut back area of the surf pool allows surfers completely their surf ride to cut out of their ride and paddle back out to the surf line up. There is a parallel break 16 side by side between the outer edge of the secondary reef sub section 2 and the side reefs 3. There is also an inside knuckle wide take off area at the top of the secondary inside reef section 17.

The underlying principle(s) of the embodiments of the present invention may be scaled to facilities of a variety of sizes and configurations. The above embodiments should be considered to be exemplary embodiments, and are in no way limiting of the present invention. Thus, while the description above refers to particular embodiments, it will be understood that many modifications may be made without departing from the spirit thereof.

The invention claimed is:

1. A surf pool comprising one continuous artificial reef wherein the artificial reef comprises premier, secondary, and side reef sections; wherein the premier reef section is triangular in shape to cause a wave to split down the middle and break into two separate surfable sections, a left barreling wave and a right barreling wave; and wherein the secondary reef section is shaped as an upside down U, wherein the top of the secondary reef section provides an inside knuckle wide take off area on both the left and right side thereof; and wherein the reef further comprises a cut back hook area at an end corner of the premier reef section to allow surfers to cut out of their ride and paddle back to a surf lineup.

* * * * *